US006742854B2

(12) United States Patent
Chen

(10) Patent No.: US 6,742,854 B2
(45) Date of Patent: Jun. 1, 2004

(54) ANTI-INCLINATION AND INTERNAL LOCKING DEVICE FOR A CABINET

(75) Inventor: Kung Cheng Chen, Taichung Hsien (TW)

(73) Assignee: E-Make Co., Ltd., Taichung Hsien (TW)

( * ) Notice: Subject to any disclaimer, the term of this patent is extended or adjusted under 35 U.S.C. 154(b) by 89 days.

(21) Appl. No.: 10/244,160

(22) Filed: Sep. 16, 2002

(65) Prior Publication Data

US 2004/0051425 A1 Mar. 18, 2004

(51) Int. Cl.[7] ..... E05B 65/46
(52) U.S. Cl. ..... 312/217; 312/221
(58) Field of Search ..... 312/215, 216, 312/217, 220, 221, 222, 107.5; 292/DIG. 18; 70/78, 85

(56) References Cited

U.S. PATENT DOCUMENTS

| | | | | | |
|---|---|---|---|---|---|
| 1,613,731 | A | * | 1/1927 | Stockov | 312/221 |
| 5,782,545 | A | * | 7/1998 | Kahara et al. | 312/217 |
| 6,347,848 | B1 | * | 2/2002 | Cho | 312/219 |
| 6,637,843 | B2 | * | 10/2003 | Westwinkel | 312/221 |

FOREIGN PATENT DOCUMENTS

| | | | | |
|---|---|---|---|---|
| DE | 2658076 | * | 7/1978 | 312/217 |
| FR | 536093 | * | 2/1922 | 312/221 |
| GB | 18241 | * | 8/1896 | 312/219 |

* cited by examiner

*Primary Examiner*—James O. Hansen
(74) *Attorney, Agent, or Firm*—Troxell Law Office PLLC

(57) ABSTRACT

Anti-inclination and internal locking device for a cabinet, including a cabinet body, at least two drawers disposed in the cabinet body, a projecting body disposed on rear side of each drawer, a base seat fixedly disposed on inner side of a rear wall board of the cabinet body corresponding to each drawer, a slide seat slidably fitted in the base seat and movable between a first position and a second position and a first and a second connecting sections respectively disposed at one end of the base seat and one end of the slide seat. The projecting body has an activating section and a stop section. The slide seat is formed with an opening corresponding to the projecting body. After one drawer is drawn out, the activating section of the projecting body of the drawn out drawer drives the slide seat and then the first connecting section is connected with the second connecting section to make the slide seat positioned in the first position, whereby the stop section of the projecting body of the other drawer is engaged with the corresponding opening.

6 Claims, 6 Drawing Sheets

ANTI-INCLINATION AND INTERNAL LOCKING DEVICE FOR A CABINET

BACKGROUND OF THE INVENTION

The present invention is related to a locking device for drawer slide rail, and more particularly to an anti-inclination and internal locking device for a tool cabinet or file cabinet having several drawers.

A drawer and a cabinet body are equipped with corresponding rails. The rails are slidably fitted with each other for easily pushing or drawing the drawer within the cabinet body. The rails are provided with stoppers such as projecting blocks or projecting plates to prevent the drawer from detaching from the cabinet body and dropping.

The drawer is often designed with a considerable length for receiving more articles. In order to fully draw the drawer out of the cabinet without being derailed and immediately push the drawer into the cabinet after taking articles, three rails are provided, that is, a cabinet body slide rail, a middle-slide rail and a drawer slide rail. Each slide rail has stop blocks on predetermined portions of one end or two ends of the slide rail. The slide rails are slidably assembled with each other and the stop blocks stop each other, whereby the drawer can be fully drawn out of the cabinet without derailing and dropping. Ball bearings are provided between the slide rails to reduce frictional force therebetween and noise.

The tool cabinet or file cabinet includes several drawers arranged from upper side to lower side. After the drawers contain tools or files, the drawers will have considerable weight. In the case that the drawers are drawn too hard or in the case of earthquake or collision by external force, the tool cabinet or file cabinet will be tilted to make some drawers slip out. Under such circumstance, the gravity center of the cabinet will change and the cabinet may fall down.

In order to avoid tilting down of the cabinet when drawing out too many drawers, a slide rail locking structure has been developed by which only one drawer can be drawn at one time. Substantially, a linking unit is disposed at one end of each slide rail assembly. Once the drawer slide rail of one slide rail assembly is pulled, the linking unit is activated to drive a link disposed between the respective slide rail assemblies to stop the drawer slide rails of other slider rail assemblies from being pulled. For example, in U.S. Pat. No. 5,352,030, a disc-like activating block is disposed at rear end of the drawer slide rail. In U.S. Pat. No. 5,634,701, an activating block having a slope is disposed at front end of one side of the drawer. In U.S. Pat. No. 5,988,778, an activating block is disposed at front end of the drawer slide rail.

In the above patents, several controlling members are disposed on the slide rail assemblies. The slide rail assemblies have limited space so that when adding the controlling members thereto, a high precision is needed to adapt the controlling members to the space between the slide rail assemblies. This increases the cost for the assembly.

SUMMARY OF THE INVENTION

It is therefore a primary object of the present invention to provide an anti-inclination and internal locking device for a cabinet, which includes simple components and can be easily assembled to prevent the cabinet from tilting.

It is a further object of the present invention to provide the above anti-inclination and internal locking device, which can more effectively and truly lock the drawers in narrow space of the cabinet body. After one of the drawers is drawn, the other drawers are prevented from being drawn out.

According to the above objects, the anti-inclination and internal locking device of the present invention includes a cabinet body, at least two drawers, a projecting body, a base seat, a slide seat, a first connecting section and a second connecting section.

The present invention can be best understood through the following description and accompanying drawings wherein:

DETAILED DESCRIPTION OF THE PREFERRED EMBODIMENTS

Figure 1:
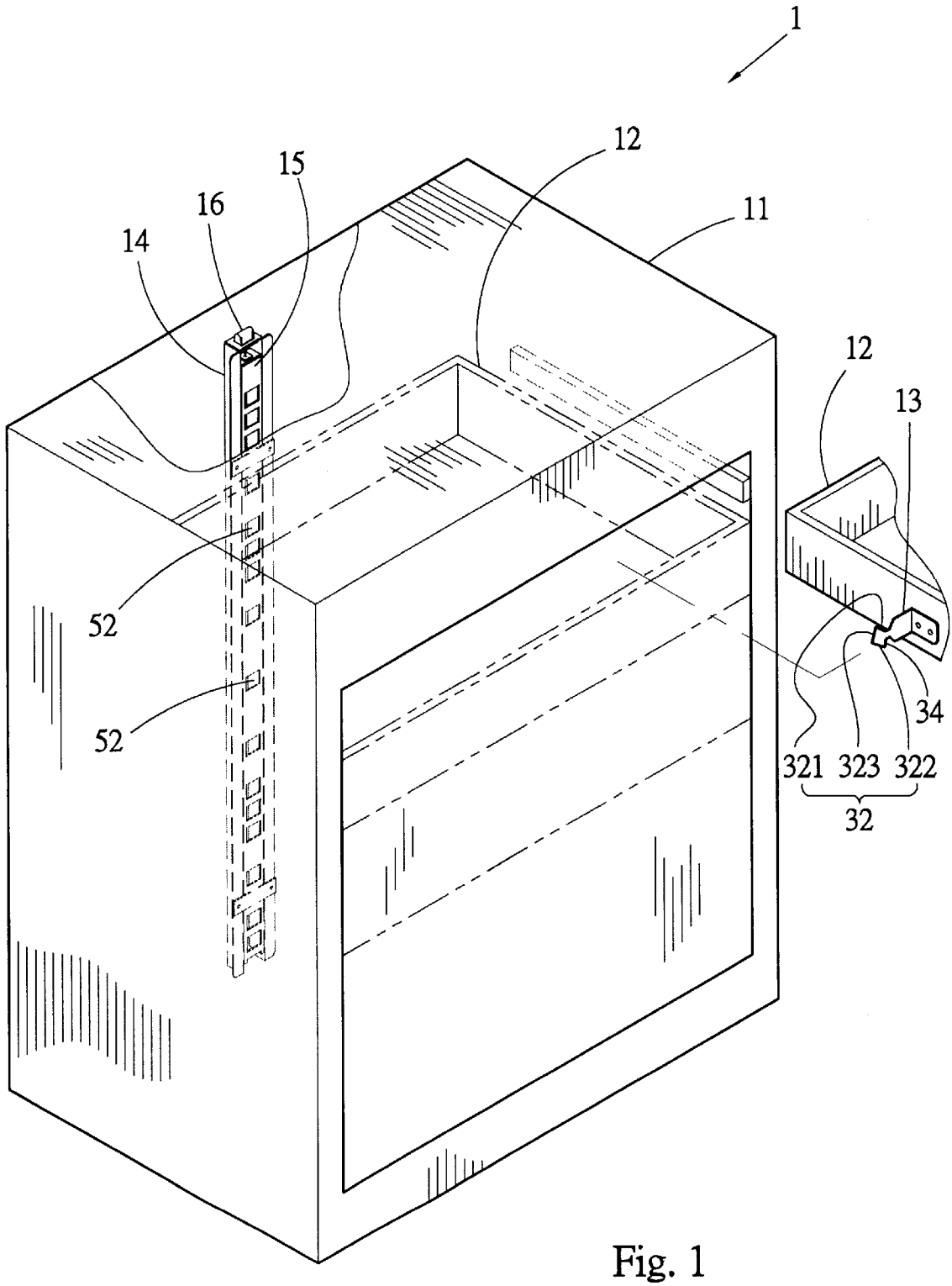
FIG. 1 is a perspective view of a preferred embodiment of the present invention.
Figure 2:
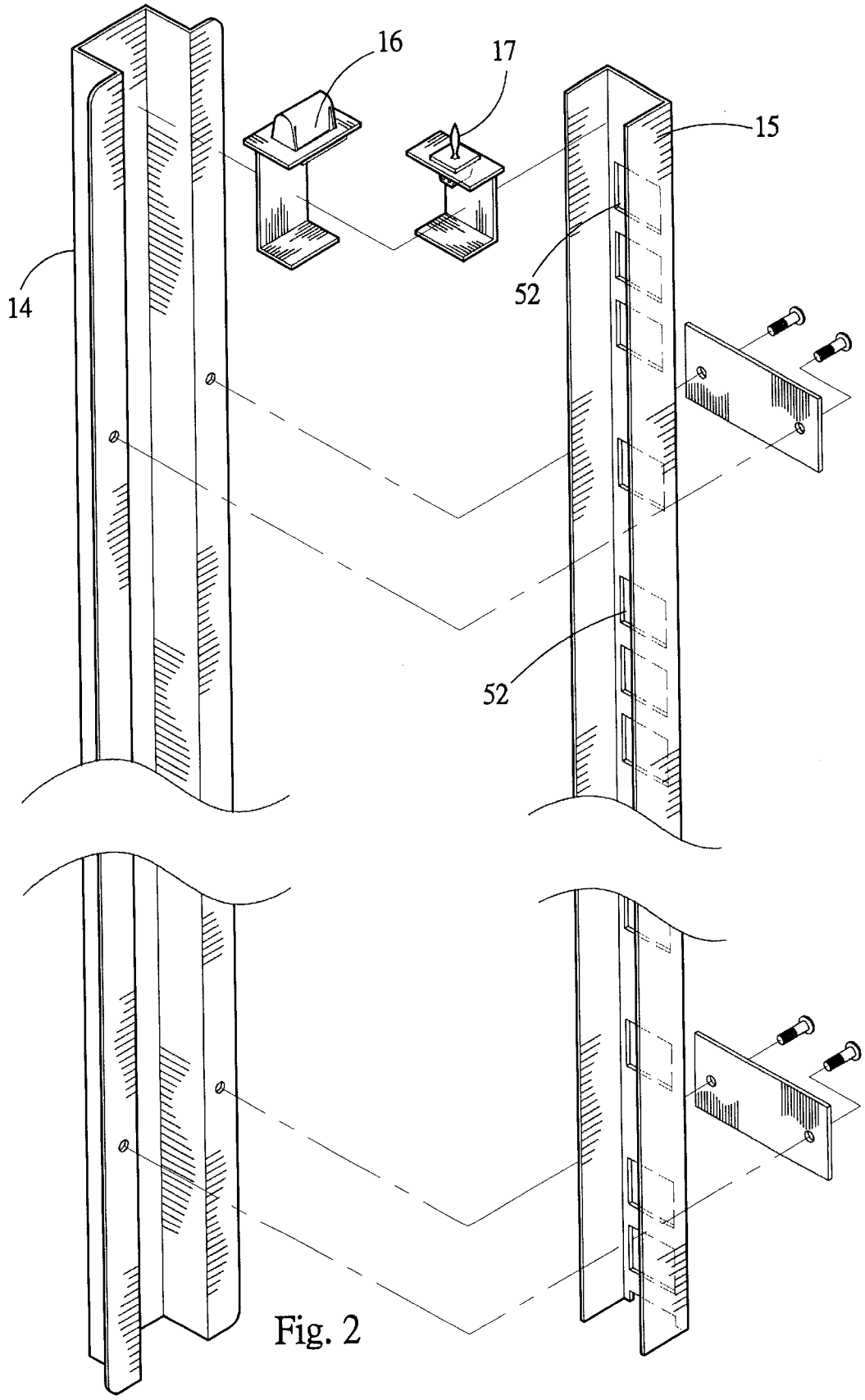
FIG. 2 is a perspective exploded view of the preferred embodiment of the present invention, showing the base seat, slide seat, first connecting section and second connecting section.
Figure 3:
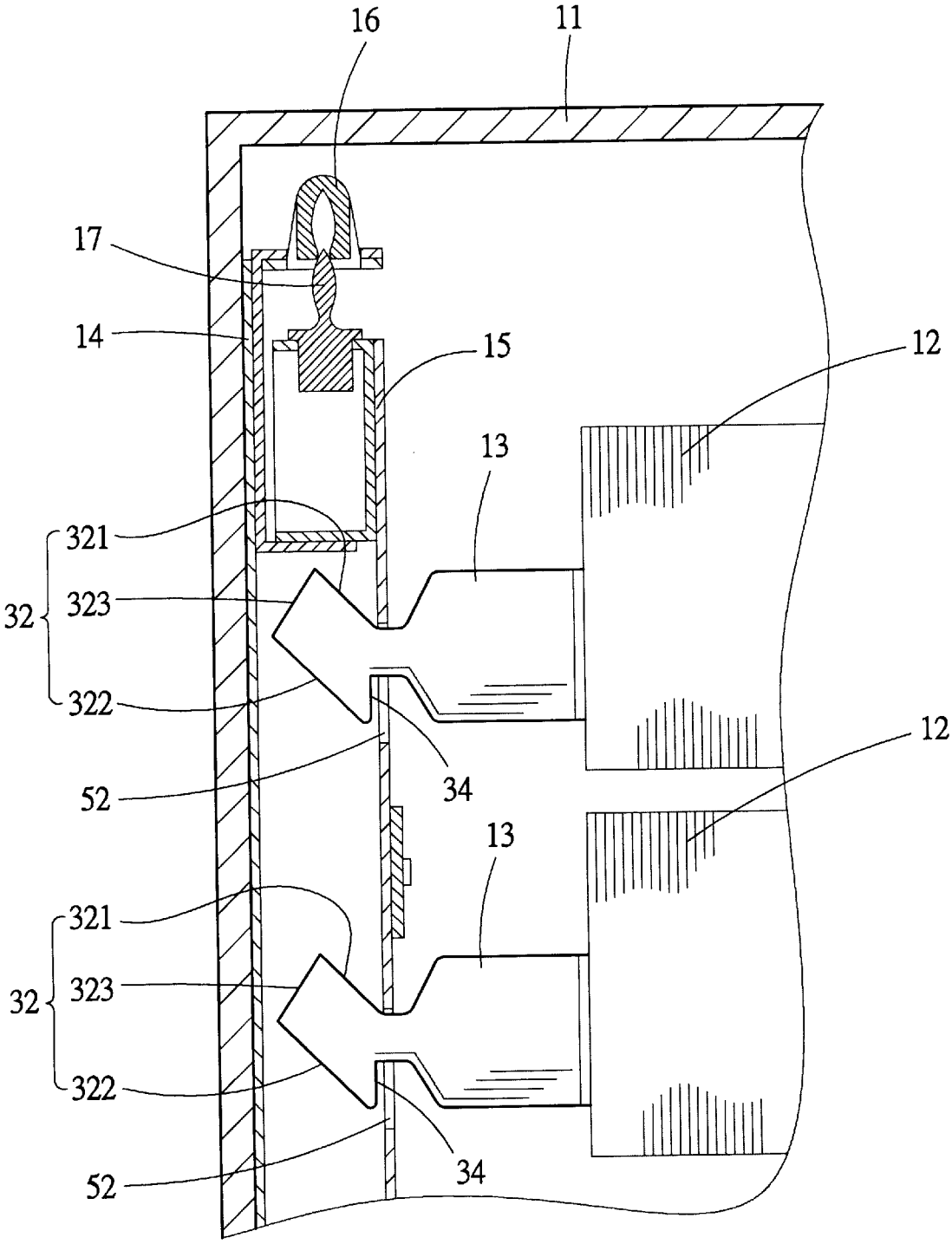
FIG. 3 is a sectional view of a part of the present invention, in which all the drawers are not drawn out.
Figure 4:
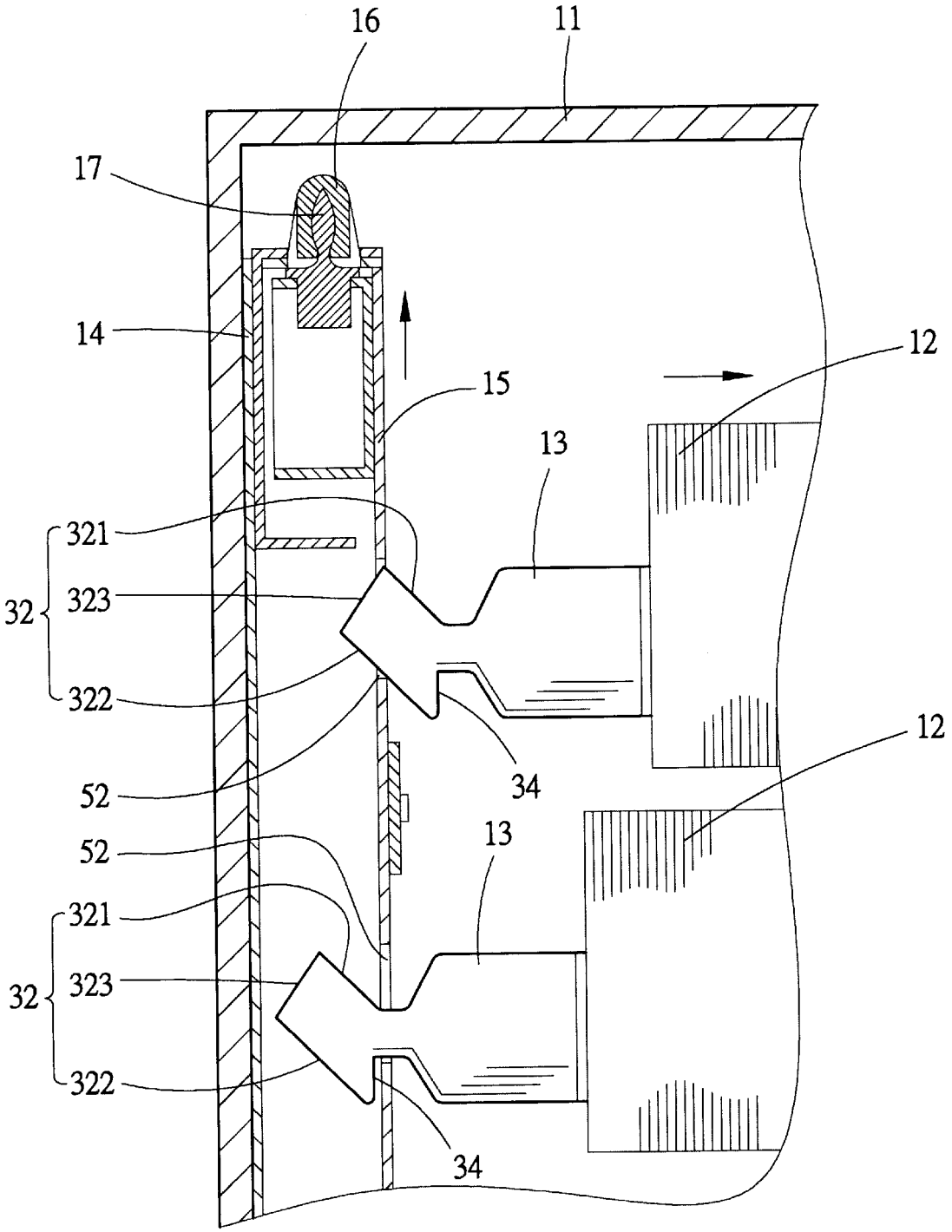
FIGS. 4 and 5 are sectional views according to FIG. 3, in which one drawer is drawn out.
Figure 5:
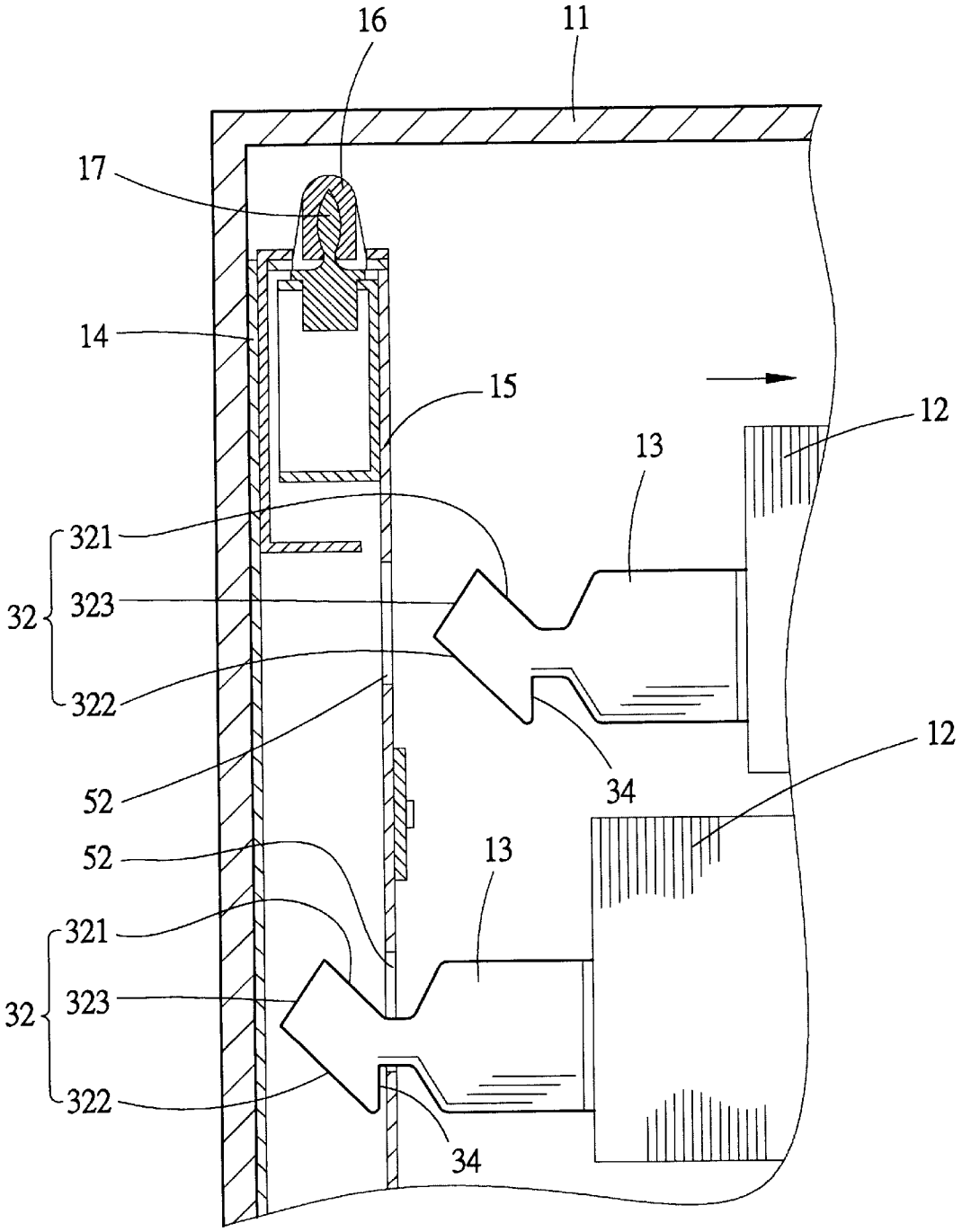

Please refer to FIGS. 1 to 5. The anti-inclination and internal locking device 1 for a cabinet of the present invention includes a cabinet body 11, at least two drawers 12, a projecting body 13, a base seat 14, a slide seat 15, a first connecting section 16 and a second connecting section 17.

The cabinet body 11 is a rectangular body composed of five rectangular wall boards defining an internal space and a vertical open face. The drawers 12 are vertically arranged in the open face and back and forth slidable. The projecting body 13 is disposed on a predetermined portion of rear side of each drawer 12. One end of the projecting body 13 has an activating section 32 and a stop section 34.

The base seat 14 is fixedly disposed on inner side of a rear wall board of the cabinet body 11 corresponding to the drawer 12.

The slide seat 15 is slidably fitted in the base seat 14. The slide seat 15 is lengthwise reciprocally movable between a first position and a second position. The slide seat 15 is formed with an opening 52 corresponding to each projecting body 13. When reciprocally moved, the activating section 32 of the projecting body 13 gets into and gets out of the corresponding opening 52 to push inner edge of the opening 52 so as to make the slide seat 15 reciprocally move between the first and second positions.

The first connecting section 16 is disposed at one end of the base seat 14. The second connecting section 17 is disposed at one end of the slide seat 15 corresponding to the first connecting section 16. After one drawer 12 is drawn out, the activating section 32 of the projecting body 13 of the drawn out drawer 12 drives the slide seat 15 upward. Then the first connecting section 16 is connected with the second connecting section 17, making the slide seat 15 positioned in the first position. Accordingly, the stop section 34 of the projecting body 13 of the other drawer 12 is engaged with the corresponding opening 52.

After the drawer 12 is again pushed in, the activating section 32 of the projecting body 13 of the pushed in drawer 12 drives the slide seat 15 downward. Then the first connecting section 16 releases the second connecting section 17, making the slide seat 15 positioned in the second position. Under such circumstance, the stop sections 34 of the projecting bodies 13 of all drawers 12 will not engage with the corresponding openings 52.

The activating section 32 includes a first slope 321 and a second slope 322.

The first slope 321 serves to push the inner edge of the corresponding opening 52 to make the slide seat 15 moved upward and connected in the first position.

The second slope 322 serves to push the inner edge of the corresponding opening 52 to make the slide seat 15 disconnected and moved downward to the second position.

By means of the above structure, only one drawer can be drawn out at one time and the other drawer is locked so as to prevent the cabinet from tilting.

The anti-inclination and internal locking device 1 of the present invention has the following advantages:

1. It is unnecessary to mount the structure of the present invention between the drawer slide rail assemblies so that the difficulty in assembly is avoided.
2. The present invention has simple components and can be easily assembled.

One end of the projecting body 13 is formed with a substantially trapezoid plate body and further has a third slope 323.

The upper side of the trapezoid forms a first slope 321, the lower side of the trapezoid forms a second slope 322 and one lateral side of the trapezoid forms a stop section 34.

The other lateral side of the trapezoid forms a third slope 323. After one drawer 12 is drawn out, the cabinet body does not suffer an expected external force so that the slide seat 15 drops down to the second position. When the drawer 12 is again pushed in, the third slope 323 pushes the inner edge of the corresponding opening 52, making the slide seat 15 moved upward and connected in the first position. Accordingly, the third slope 323 serves as an insurance device for restoring the present invention.

The first connecting section 16 is a resilient clamp body having an internal cavity and a lower opening.

The second connecting section 17 is a rod body positioned under the first connecting section 16.

The rod body has an elliptic cross-section. The shape of the internal cavity of the clamp body is adapted to the profile of the rod body.

Figure 6:
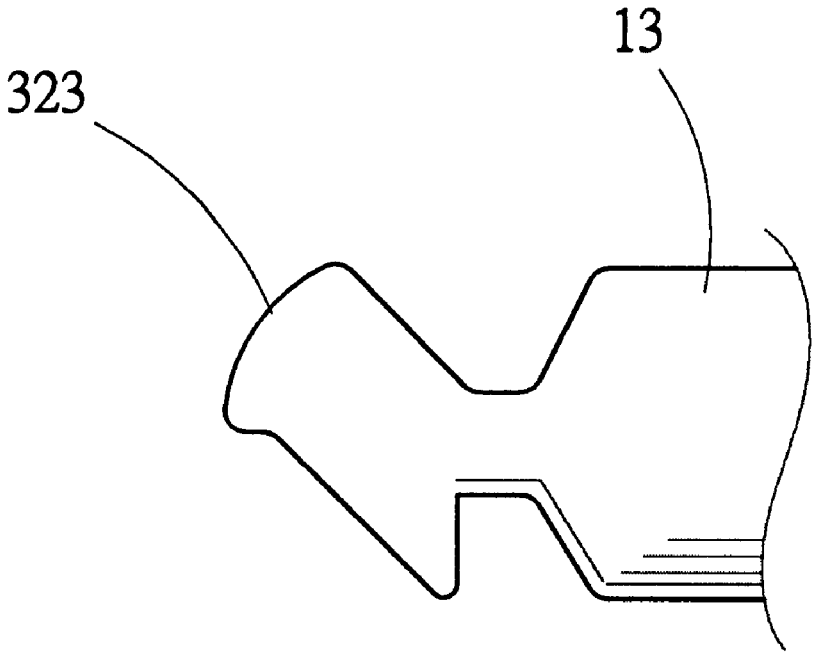
FIG. 6 shows the projecting body of another embodiment of the present invention.

Referring to FIG. 6, the third slope 323 of the projecting body 13 is an inclined arched face which can achieve the same function.

The above embodiments are only used to illustrate the present invention, not intended to limit the scope thereof. Many modifications of the above embodiments can be made without departing from the spirit of the present invention.

What is claimed is:

1. Anti-inclination and internal locking device for a cabinet, comprising:

a cabinet body which is a rectangular body composed of five rectangular wall boards defining an internal space and a vertical open face, at least two drawers being back and forth slidably disposed in the open face, a projecting body being disposed on a predetermined portion of rear side of each drawer, one end of the projecting body having an activating section and a stop section;

a base seat fixedly disposed on inner side of a rear wall board of the cabinet body corresponding to each drawer;

a slide seat slidably fitted in the base seat, the slide seat being reciprocally movable between a first position and a second position, the slide seat being formed with an opening corresponding to each projecting body, whereby when reciprocally moved, the activating section of the projecting body gets into and gets out of the corresponding opening to push inner edge of the opening so as to make the slide seat reciprocally move between the first and second positions; and a first connecting section disposed at one end of the base seat; and a second connecting section disposed at one end of the slide seat corresponding to the first connecting section, after one drawer is drawn out, the activating section of the projecting body of the drawn out drawer driving the slide seat and then the first connecting section being connected with the second connecting section to make the slide seat positioned in the first position, whereby the stop section of the projecting body of the other drawer is engaged with the corresponding opening, after the drawer is again pushed in, the activating section of the projecting body of the pushed in drawer driving the slide seat and then the first connecting section releasing the second connecting section to make the slide seat positioned in the second position, whereby the stop sections of the projecting bodies of all drawers will not engage with the corresponding openings.

2. Anti-inclination and internal locking device for a cabinet as claimed in claim 1, wherein the activating section has a first slope and a second slope, the first slope serving to push the inner edge of the corresponding opening to make the slide seat moved and connected in the first position, the second slope serving to push the inner edge of the corresponding opening to make the slide seat moved and disconnected in the second position.

3. Anti-inclination and internal locking device for a cabinet as claimed in claim 2, wherein one end of the projecting body is formed with a substantially trapezoid plate body and further has a third slope, an upper side of the trapezoid forming a first slope, a lower side of the trapezoid forming a second slope and one lateral side of the trapezoid forming a stop section, the other lateral side of the trapezoid forming a third slope, whereby after one drawer is drawn out, the cabinet body does not suffer an expected external force so that the slide seat drops down to the second position and when the drawer is again pushed in, the third slope pushes the inner edge of the corresponding opening, making the slide seat moved and connected in the first position.

4. Anti-inclination and internal locking device for a cabinet as claimed in claim 3, wherein the third slope is an inclined arched face.

5. Anti-inclination and internal locking device for a cabinet as claimed in claim 1, wherein the first connecting section is a resilient clamp body having an internal cavity and an opening and the second connecting section is a rod body.

6. Anti-inclination and internal locking device for a cabinet as claimed in claim 5, wherein the rod body has an elliptic cross-section, a shape of the internal cavity of the clamp body being adapted to the profile of the rod body.

* * * * *